US010731434B2

(12) United States Patent
Jackson et al.

(10) Patent No.: US 10,731,434 B2
(45) Date of Patent: Aug. 4, 2020

(54) HANGER ASSEMBLY WITH PENETRATORS

(71) Applicant: Baker Hughes, A GE Company, LLC, Houston, TX (US)

(72) Inventors: Todd C. Jackson, Haarlem (NL); Ewan Sinclair, Aberdeen (GB)

(73) Assignee: Baker Hughes, A GE Company, LLC, Houston, TX (US)

( * ) Notice: Subject to any disclaimer, the term of this patent is extended or adjusted under 35 U.S.C. 154(b) by 211 days.

(21) Appl. No.: 15/970,424

(22) Filed: May 3, 2018

(65) Prior Publication Data

US 2018/0320471 A1 Nov. 8, 2018

Related U.S. Application Data

(60) Provisional application No. 62/500,891, filed on May 3, 2017.

(51) Int. Cl.

| | |
|---|---|
| ***E21B 33/04*** | (2006.01) |
| ***E21B 33/068*** | (2006.01) |
| ***E21B 43/12*** | (2006.01) |

(52) U.S. Cl.

CPC ..... *E21B 33/0407* (2013.01); *E21B 33/068* (2013.01); *E21B 43/128* (2013.01)

(58) Field of Classification Search

CPC ..... E21B 33/038; E21B 33/0385; E21B 33/04
See application file for complete search history.

(56) References Cited

U.S. PATENT DOCUMENTS

| | | | | | |
|---|---|---|---|---|---|
| 2,178,700 | A * | 11/1939 | Penick | E21B 33/04 | 166/78.1 |
| 3,043,371 | A * | 7/1962 | Rector | E21B 33/04 | 166/97.1 |
| 3,246,919 | A * | 4/1966 | Todd | E21B 33/04 | 285/84 |
| 3,739,846 | A * | 6/1973 | Beson | E21B 33/047 | 166/89.2 |

(Continued)

FOREIGN PATENT DOCUMENTS

| | | | | |
|---|---|---|---|---|
| CA | 1237072 A * | 5/1988 | ..... | E21B 33/04 |
| EP | 0637675 B1 | 6/1998 | | |

(Continued)

OTHER PUBLICATIONS

International Search Report and Written Opinion dated Aug. 14, 2018 for corresponding PCT/US2018/030735.

*Primary Examiner* — Jennifer H Gay
(74) *Attorney, Agent, or Firm* — Bracewell LLP; James E. Bradley

(57) ABSTRACT

A wellhead assembly has a tubular wellhead body with a wellhead axial bore and a wellhead radial bore. A hanger has a hanger axial bore and a hanger radial port. A tube moving mechanism moves a tube in the wellhead radial bore between a retracted position, an intermediate position and an extended position. The tube has an inner end that is recessed in the wellhead radial bore while in the retracted position, that protrudes a first distance into the wellhead axial bore while in the intermediate position, and which protrudes a second distance into engagement with the hanger radial port while in the extended position. A landing shoulder on the hanger above the radial port lands on an inner portion of the tube while the tube is in the intermediate position.

20 Claims, 6 Drawing Sheets

(56) References Cited

U.S. PATENT DOCUMENTS 4,181,175 A * 1/1980 McGee ..... E21B 33/068 166/88.4
4,214,778 A * 7/1980 Diehl ..... E21B 33/04 166/89.2
4,384,730 A * 5/1983 Diehl ..... E21B 33/04 277/322
4,491,176 A * 1/1985 Reed ..... E21B 33/0407 166/66.4
4,650,226 A * 3/1987 Babbitt ..... F16L 25/065 285/123.13
4,770,250 A * 9/1988 Bridges ..... E21B 33/04 166/382
4,791,986 A * 12/1988 Vallet ..... E21B 33/04 166/379
4,919,459 A * 4/1990 Miller ..... E21B 33/03 285/123.8
4,923,006 A * 5/1990 Hartmann ..... E21B 17/003 166/65.1
6,012,519 A * 1/2000 Allen ..... E21B 33/04 166/208
6,394,837 B1 * 5/2002 Edwards ..... H01R 13/523 439/426
8,397,822 B2 3/2013 Tetzlaff et al.
8,720,578 B2 * 5/2014 Allensworth ..... E21B 33/038 166/341
8,985,972 B2 3/2015 Tetzlaff et al.
9,103,182 B2 * 8/2015 Sinnott ..... E21B 33/038
9,556,698 B2 * 1/2017 Nguyen ..... E21B 33/03
9,790,760 B2 * 10/2017 Nguyen ..... E21B 33/0422
10,138,699 B2 * 11/2018 Nguyen ..... E21B 33/0415
2005/0067167 A1 * 3/2005 Hall ..... E21B 33/038 166/379
2008/0023191 A1 * 1/2008 Khehra ..... E21B 33/04 166/75.14
2008/0185156 A1 * 8/2008 Rodgers ..... E21B 33/04 166/379
2011/0024108 A1 * 2/2011 Guidry ..... E21B 33/04 166/250.01
2011/0278013 A1 * 11/2011 Allensworth ..... E21B 17/07 166/344
2012/0305269 A1 12/2012 Bories et al.
2013/0168104 A1 * 7/2013 Sinnott ..... E21B 33/038 166/379
2016/0186520 A1 * 6/2016 Nguyen ..... E21B 33/04 166/382
2016/0186521 A1 * 6/2016 Nguyen ..... E21B 33/0422 166/382
2016/0186523 A1 * 6/2016 Nguyen ..... E21B 33/0415 166/382
2017/0241424 A1 8/2017 Patil et al.
2018/0320471 A1 * 11/2018 Jackson ..... E21B 33/0407

FOREIGN PATENT DOCUMENTS

WO WO-2004083598 A1 * 9/2004 ..... E21B 33/04
WO 20150153541 A1 10/2015

* cited by examiner

HANGER ASSEMBLY WITH PENETRATORS

CROSS REFERENCE TO RELATED APPLICATION

This application claims priority to provisional application Ser. No. 62/500,891, filed May 3, 2017.

FIELD OF THE DISCLOSURE

This disclosure relates in general to a coiled tubing hanger assembly for a wellhead, and more particularly to laterally extending penetrators that extend through a flange into engagement with the hanger for providing electrical power to a submersible pump, monitoring downhole sensors, and/or pumping liquids down the coiled tubing.

BACKGROUND

Electrical submersible pumps (ESP) are installed in many hydrocarbon producing wells to pump the well fluid. In one type of installation, a string of coiled tubing supports the ESP. Coiled tubing is a continuous length of steel pipe that can be deployed from a reel in the vicinity of the wellhead or production tree. Normally, an electrical power cable extends through the coiled tubing for providing power to the ESP. The ESP pumps well fluid up an annulus in the well surrounding the coiled tubing.

A coiled tubing hanger secures to the upper end of the coiled tubing to support the coiled tubing. The coiled tubing hanger lands in one of the components of the production tree. A variety of arrangements may be employed to connect the insulated conductors of the power cable to an electrical power source adjacent the production tree. The installation of a coiled tubing supported ESP may be made to an existing well that previously produced naturally.

SUMMARY

A wellhead assembly has a tubular wellhead body having a wellhead axial bore with an axis. A wellhead radial bore extends along a radial line from an outer periphery of the wellhead body to the wellhead axial bore. A hanger has a landed position within the wellhead axial bore, the hanger having a hanger axial bore. A hanger radial port extends radially from an exterior surface of the hanger to the hanger axial bore. A tube is sealingly carried in the wellhead radial bore. The tube is movable between a retracted position and an extended position. The tube has an inner end that is recessed in the wellhead radial bore while in the retracted position and protrudes into the wellhead axial bore into engagement with the hanger radial port while in the extended position. A flow passage exists between the exterior surface of the hanger and a side wall of the wellhead axial bore, enabling a flow of fluid up and down the wellhead axial bore while the hanger is in the landed position.

A landing shoulder on the hanger rests on an inner end portion of the tube while the tube is in the extended position and the hanger is in the landed position. A load imposed on the hanger transfers to the tube while the hanger is in the landed position.

The tube is movable to an intermediate position between the retracted and extended positions prior to the hanger being lowered to the landed position. The hanger has an alignment slot extending downward from the hanger radial port. The alignment slot has opposed cam surfaces converging toward each other in an upward direction that slidingly engage the tube while the tube is in the intermediate position and the hanger is being lowered into the wellhead axial bore. The sliding engagement causes the hanger to rotationally orient the hanger radial port with the inner end of the tube. Subsequent movement of the tube from the intermediate position to the extended position causes the inner end of the tube to sealingly engage the hanger radial port.

A landing shoulder is located at an upper end of the alignment slot. The landing shoulder lands on the tube while the tube is in the intermediate position and transfers a load on the hanger to the tube.

In the embodiment shown, the hanger has a hanger body and a guide member extending around and affixed to the hanger body. The alignment slot is in the guide member. A portion of the flow passage extends between the hanger body and the guide member.

In one example, the flow passage includes an annular cavity extending around the hanger body. The guide member surrounds the annular cavity. The hanger radial port is located above the annular cavity. A lower flow channel extends between the guide member and the hanger body and leads from a lower portion of the hanger body to the annular cavity. The lower flow channel is positioned in vertical alignment with the hanger radial port. An upper flow channel between the guide member and the hanger body leads upward from the annular cavity. The upper flow channel is rotationally offset from the radial port and the lower flow channel. Upward flowing fluid flows through the lower flow channel, the annular cavity, and the upper flow channel.

A threaded adjustment nut on an outer end portion of the tube and an outer portion of the wellhead body moves the tube between the retracted and extended positions in response to rotation of the adjustment nut.

The hanger has a maximum outer diameter that is less than a minimum inner diameter of the wellhead axial bore.

A string of coiled tubing contains an electrical cable. A coiled tubing head at an upper end of the string of coiled tubing mounts within the hanger axial bore. The coiled tubing head has a coiled tubing head electrical contact aligned with the radial port in the hanger. A tube electrical contact within a tube bore of the tube engages the coiled tubing head electrical contact while the tube is in the extended position.

DETAILED DESCRIPTION OF THE DISCLOSURE

Figure 1:
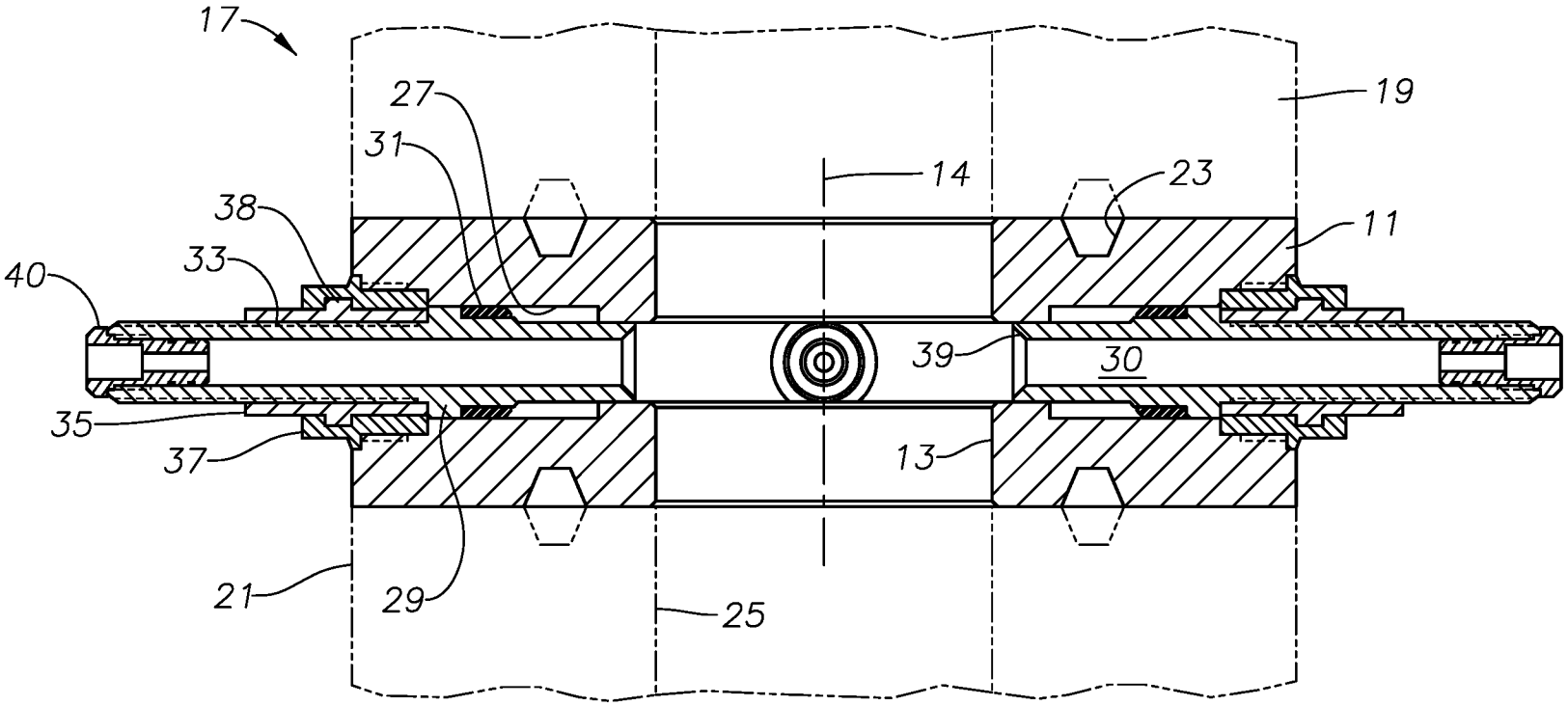
FIG. 1 is a sectional view showing a flange with penetrator tubes constructed in accordance with this disclosure.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" are used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a wellhead tubular body or flange 11 has an axial bore 13 concentric with an axis 14. Flange 11 secures into a stack of wellhead components or a production tree 17 that may be conventional. Flange 11 has an upper side and a lower side that are flat and located in planes perpendicular to axis 14. An upper tree component or spool 19 of production tree 17 mounts on top of flange 11. Flange 11 mounts on a lower component or spool 21 of production tree 17. Annular channels 23 in the upper and lower sides of flange 11 mate with channels in upper and lower spools 19, 21 and contain seals (not shown).

A wellhead or tree axial bore 25 extends through production tree 17. Tree bore 25 has a minimum diameter that may be the same in lower spool 21 as in upper spool 19. Flange axial bore 13 has the same minimum diameter as tree bore 25. Production tree 17 will be located at the upper end of a well and have a string of production tubing (not shown) suspended by a production tubing hanger (not shown) landed in one of the components below flange 11, such as lower spool 21. Production tree 17 has a number of valves (not shown) for pressure control of the well fluid flowing up production tree bore 25, including production flow valves located in a component above, such as upper spool 19.

Flange 11 has at least one, and preferably several radial bores 27 extending outward from bore recess 15 to the periphery along radial lines of axis 14. In this embodiment, there are four radial bores 27, each 90 degrees apart from another, but the number and spacing could differ. Each radial bore 27 has a smaller inner diameter than the inner diameter of axial bore 13.

Figure 6:
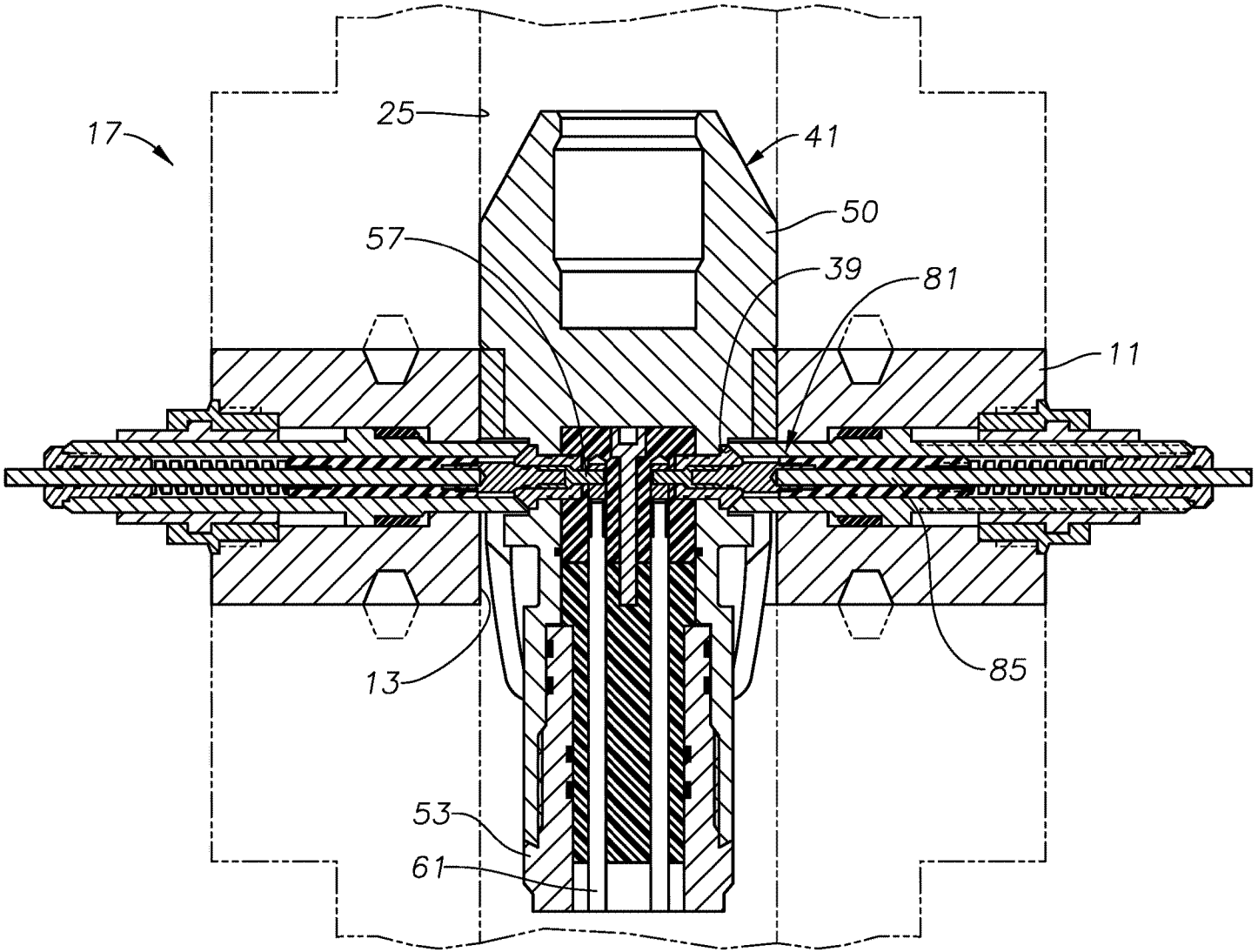
FIG. 6 is a sectional view of the hanger landed in the flange, and showing electrical connectors installed in the penetrator tubes.

A penetrator tube 29 secures in each radial bore 27. Each tube 29 is sealed in one of the radial bores 27 by a seal 31 and has a passage 30 extending through it. A tube moving mechanism selectively moves tube 29 in radial bore 27 between a retracted position (FIG. 1), an intermediate position (FIG. 2), and an extended position (FIG. 6). In this example, the tube moving mechanism includes a set of threads 33 on the outer diameter of each tube 29 at its outer end. An adjustment nut 35 engages threads 33. Adjustment nut 35 is located in a retainer sleeve 37 that secures to internal threads in radial bore 27. Adjustment nut 35 has an outer band 38 that fits within an annular recess in the inner diameter of retainer sleeve 37. Band 38 prevents adjustment nut 35 from moving along the axis of radial bore 27.

Figure 2:
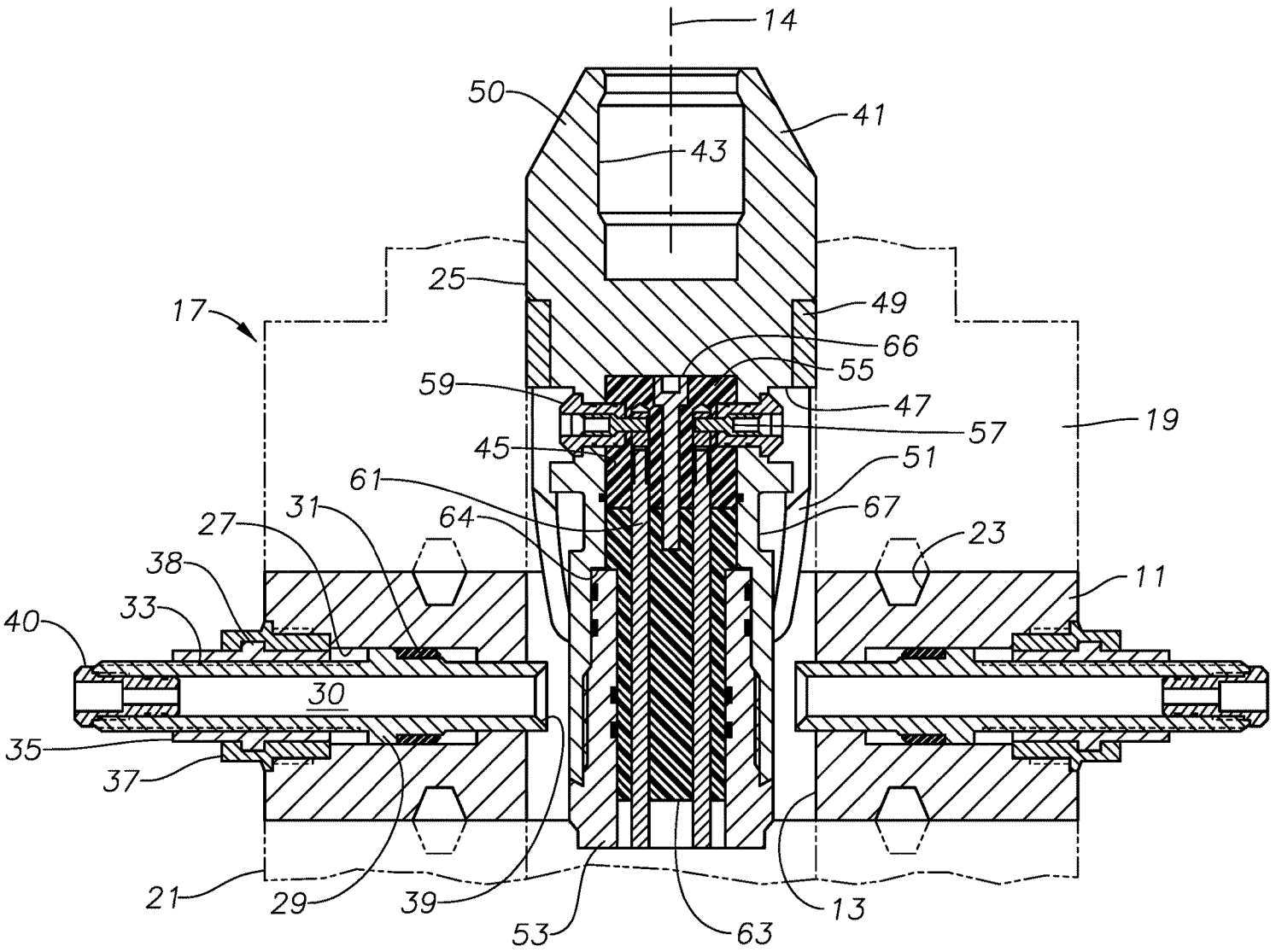
FIG. 2 is a sectional view of the flange of FIG. 1, showing a hanger being lowered into the flange bore in accordance with this disclosure.

FIG. 1 shows adjustment nut 35 rotated to position tube 29 in a retracted position with a seal face 39 on its inner end retracted from axial bore 13. While in the retracted position, tools and other equipment that have outer diameters only slightly less than the inner diameter of bores 13 and 25 can be lowered through axial bore 13. FIG. 1 shows a plug 40 temporarily secured in the outer end of each tube 29. Plug 40 seals passage 30 in tube 29, enabling pressure testing and other operations that apply pressure to axial bore 13. Referring to FIG. 2, adjustment nuts 35 have been rotated to an intermediate position, placing tubes 29 with their seal faces 39 protruding a first distance into axial bore 13.

FIG. 2 shows a hanger 41 being lowered into axial bore 13. Hanger 41 may be employed to support coiled tubing, which may contain a power cable of an electrical submersible pump (ESP), or alternately, the power cable itself without coiled tubing, or still further, a small diameter capillary tubing. Hanger 41 has a conventional lifting receptacle 43 on its upper end for engagement by a tool to lower and lift hanger 41. Hanger 41 has an axial bore 45 extending up from its lower end. The upper end of hanger bore 45 terminates below the lower end of lifting receptacle 43 and does not join it in this example. Hanger 41 has radial ports 47 extending radially from its outer side to hanger bore 45. If four tubes 29 are employed, hanger ports 47 will be spaced apart 90 degrees apart from each other to align with flange radial bores 27 and tubes 29.

Hanger 41 may include a guide member 49 mounted on its exterior that has orienting slots 51 that contact tubes 29 while in the intermediate position. Continuing to lower hanger 41 causes orienting slots 51 to rotate hanger 41 and orient radial ports 47 with tubes 29. In this embodiment, there are no landing shoulders formed in any of the axial bores 13, 25 or 45; rather hanger 41 lands on the inner end portions of tubes 29 while in the intermediate position and transfers the weight or load on hanger 42 to tubes 29.

After landing hanger 41 on tubes 29 while they are in the intermediate position, technicians will rotate adjustment nuts 35 to position tubes 29 in the extended position. In the extended position, tube seal faces 39 will sealingly engage hanger radial ports 47. Plugs 40 can be removed for pressure testing through tube passages 30.

An upper portion 53 of a coiled tubing connector has threads that secure it to threads in the lower end of hanger bore 45. In this example, hanger bore 45 holds a mounting system for supplying three-phase electrical power from three of tubes 29 to an ESP. In addition to electrical power, well fluid treating chemicals can be pumped through one of the tubes 29 and down a passage in the mounting system within hanger bore 45. Alternately, hanger bore 45 and one or more tube passages 30 could be employed for injecting liquids or hydraulic fluid through tubes 29 in addition to or rather than supplying power to an ESP.

The coiled tubing mounting system may vary, and in this example, a cap 55 of electrical insulation material is at the upper end of hanger bore 45. Cap 55 has an inner electrical contact 57 for each of the three phases of the ESP. Each inner electrical contact 57 is aligned with one of the radial ports 47. Optionally, a fourth inner electrical contact 57 could be employed for receiving signals from down hole sensors. The fourth inner electrical contact 57 could be fiber optic instead of electrical. Also, instead of a fourth inner electrical contact 57, the fourth penetrator tube 29 could be used to supply treating chemicals to a capillary line (not shown) extending downward through cap 55 to the ESP.

Figure 7:
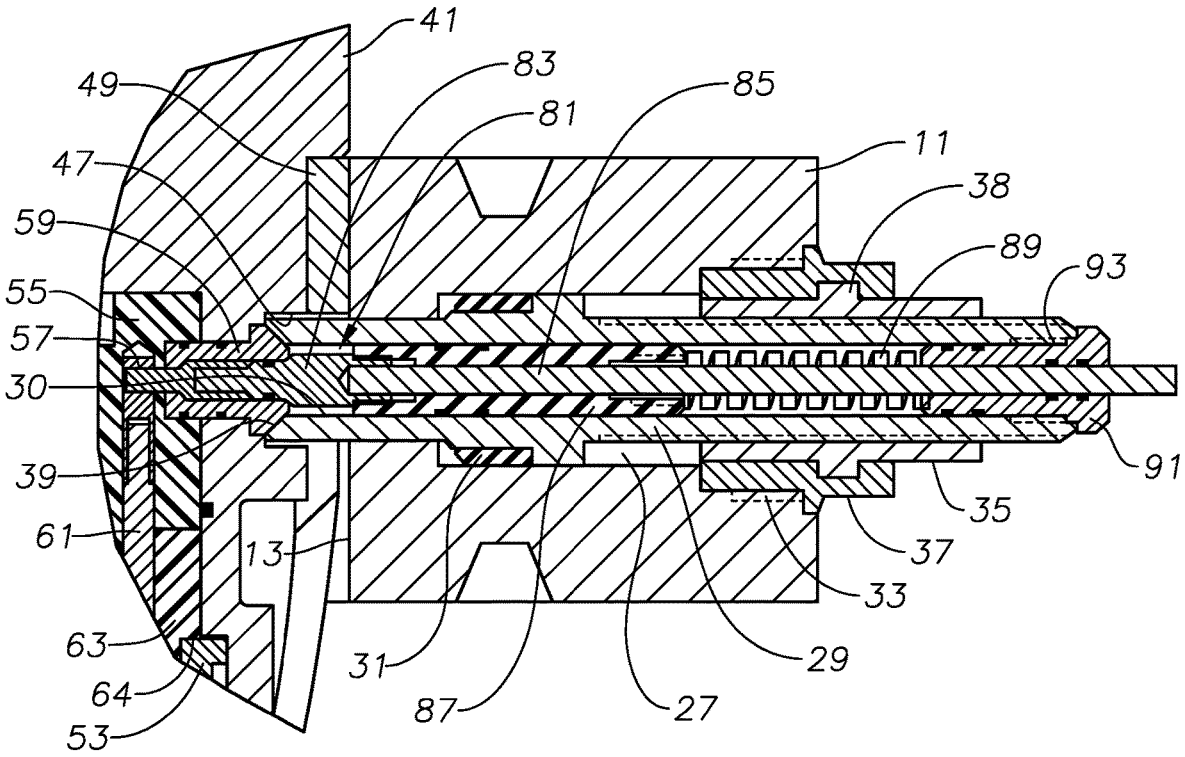
FIG. 7 is an enlarged view of the portion in FIG. 6 surrounded by a dashed line.

As shown also in FIG. 7, each inner electrical contact 57 extends outward into a radial seal or insulator 59. Each radial insulator 59 has a conical outer end for sealingly mating with one of the inner seal faces 39 of one of the tubes 29. The conical end of insulator 59 is recessed a short distance into the hanger radial port 47. An insulated electrical wire or conductor 61 has a terminal on its upper end that joins each inner electrical contact 57 in cap 55 and extends downward through a separate passage in an electrical insulator 63. Insulator 63 has a downward facing shoulder 64 that abuts an upper end of upper coiled tubing connector portion 53. A screw 66 secures cap 55 to insulator 63.

Figure 3:
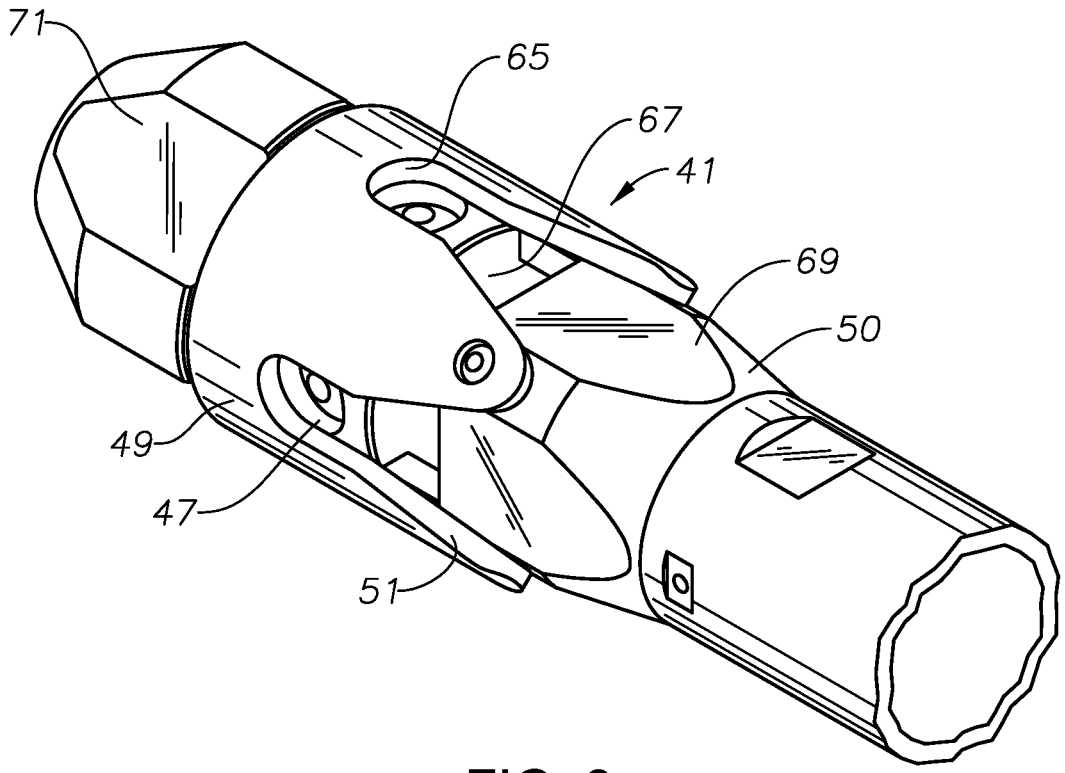
FIG. 3 is an isometric view of the hanger of FIG. 2, shown removed from the flange.

Referring to FIG. 3, in this example, guide member 49 is a separate component attached to a body 50 of hanger 41 by fasteners. Guide member 49 has a cylindrical upper portion that slides over body 50 of hanger 41. Orienting slots 51 extend upward from the lower edge of guide member 49. Each set of orienting slots 51 has sides edges that oppose each other and converge toward each other in an upward direction. The upper end of each orienting slot 52 joins a curved downward facing load or support shoulder 65. Support shoulder 65 lands on the protruding inner portion of one of the tubes 29 (FIG. 2) while tube 29 is in the intermediate position. Support shoulder 65 extends partially around and over one of the hanger radial ports 47.

Figure 4:
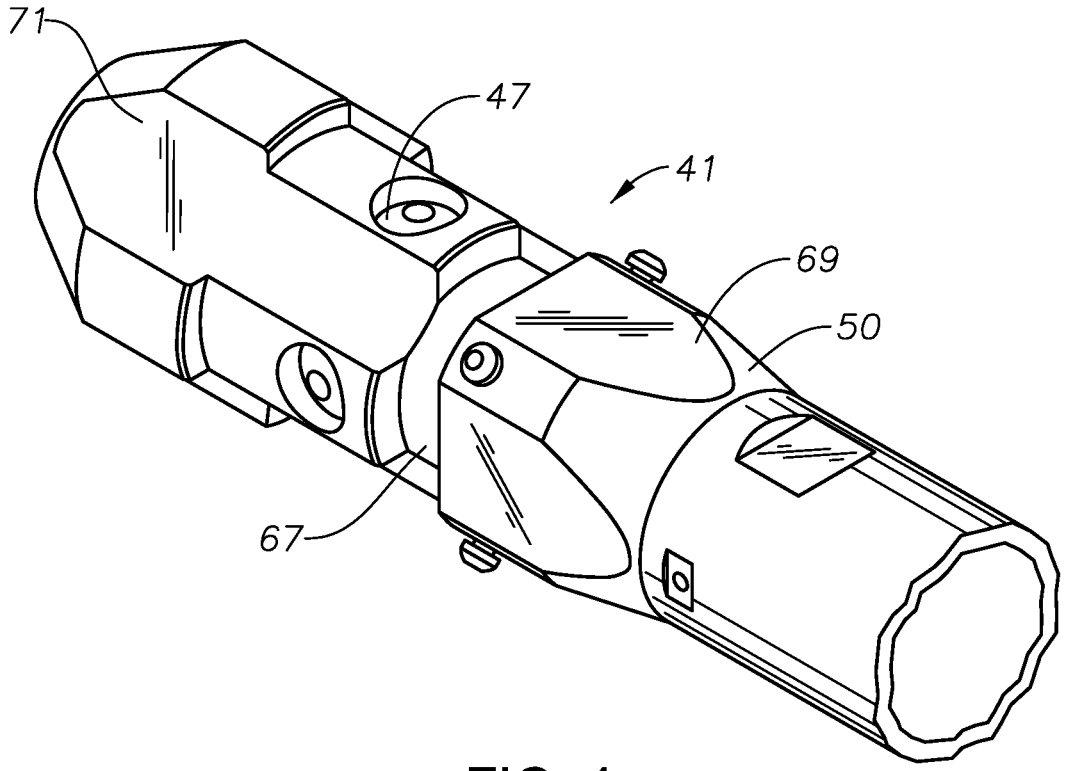
FIG. 4 is an isometric view of the hanger of FIG. 3, shown with the guide member removed.

FIG. 4 shows hanger body 50 with guide member 49 removed. Body 50 of hanger 41 has a number of lower flow channels 69, which may be flat surfaces, on the cylindrical outer side of hanger body 50. Lower flow channels 69 extend upward and join an annular cavity 67 extending around body 50 of hanger 41. Upper flow channels 71, which may also be flat, extend upward from annular cavity 67. In this embodiment, each upper flow channel 71 is rotationally located between two of the lower flow channels 69. Each upper flow channel 71 extends between adjacent radial ports 47. The upper cylindrical portion of guide member 49 (FIG. 3) extends over upper flow channels 71, but does not block them. Flow channels 69, annular cavity 67 and flow channels 71 define continuously open flow paths between hanger 41 and the inner wall of axial bore 13. Well fluid flowing up tree bore 25 (FIG. 1) can flow up channels 69, into annular cavity 67, and up channels 71. There is no annular seal between hanger 41 and hanger axial bore 13 or the axial bores 25 in tree spools 19, 21. Thus fluid can flow between hanger axial bore 13 and hanger 41 to tree bore 25 in upper spool 19. Also, fluid can flow down flange axial bore 13 along the same paths.

Figure 5:
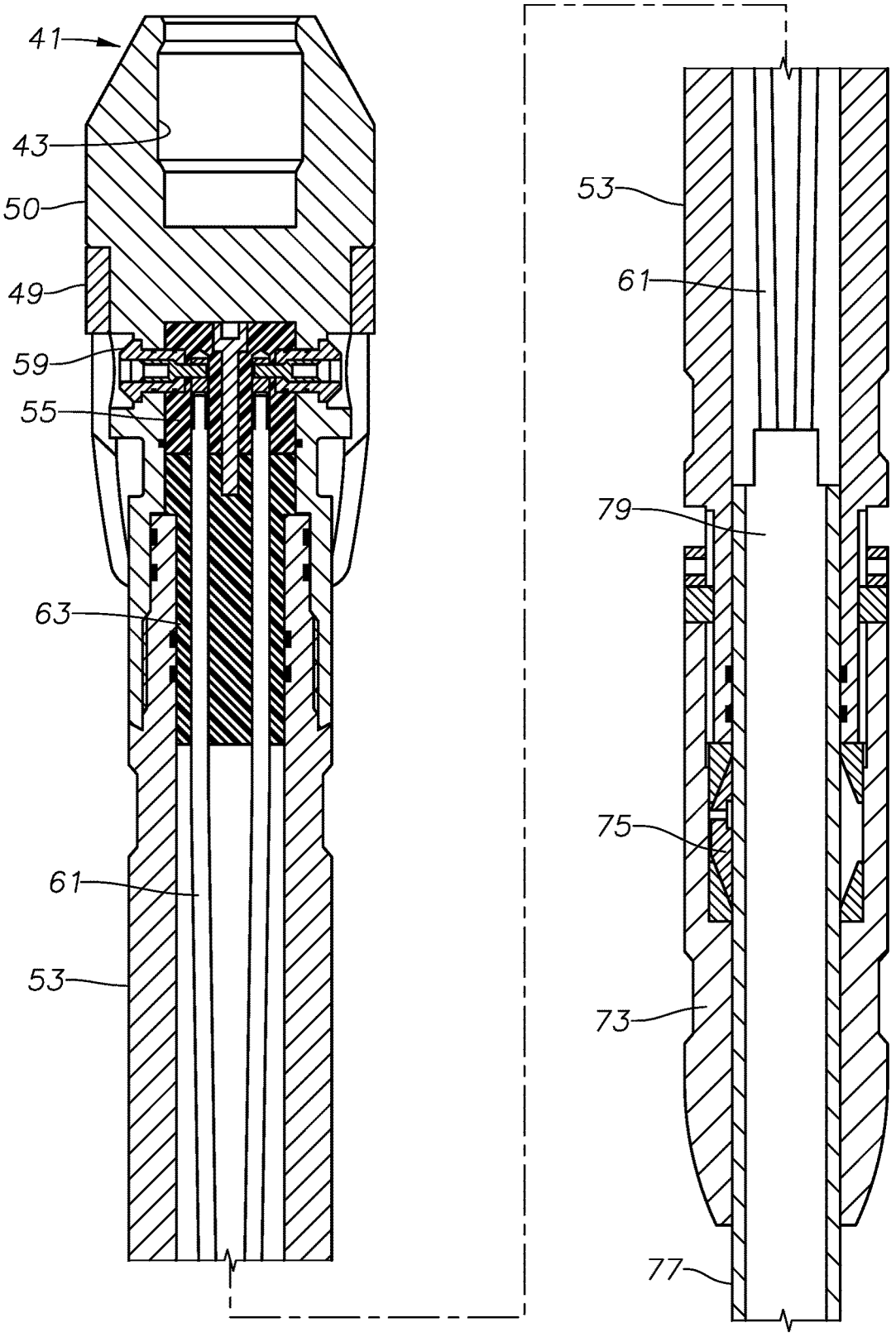
FIG. 5 is a sectional view of the hanger of FIG. 2, shown removed from the flange.

Referring to FIG. 5, a lower portion 73 of a coiled tubing connector secures by threads to upper coiled tubing connector portion 53. Lower coiled tubing connector portion 73 may be conventional, having slips 75 that grip a string of coiled tubing 77. Coiled tubing 77 is a continuous string of steel tubing that extends into the well. In this instance, coiled tubing 77 typically extends through larger diameter production tubing made up of joints of pipe secured together by threaded ends. Coiled tubing 77 has the ability to be wound around a reel (not shown) on the surface for running and retrieval.

In this embodiment, an electrical power cable 79 extends through coiled tubing 77 to an ESP (not shown) secured to the lower end of coiled tubing 77. Power cable 79 may have features on its outer diameter to frictionally grip the inner diameter of coiled tubing 77 to transfer its weight to coiled tubing 77. Power cable 79 includes the three insulated conductors 61, which are normally embedded in a single elastomeric jacket. Power cable 79 may also include a capillary tube (not shown) for injecting treating chemicals. The insulated conductors 61 extend from the upper end of coiled tubing 77 into insulator 63 and to inner electrical contacts 57 (FIG. 1). A dielectric silicone gel or the like may be injected through a port in body 50 of hanger 41 to fill the spaces in upper connector portion 53 from the upper end of coiled tubing 77 up to inner electrical contacts 57.

FIG. 6 shows hanger 41 in the landed position in flange axial bore 13. It also shows electrical connectors 81 installed in each tube 29. The installation of electrical connectors 81 is performed after plugs 40 (FIG. 1) have been removed and pressure testing accomplished. FIG. 7 shows an enlarged view of the portion of FIG. 6 surrounded by a dashed line. Electrical connector 81 may vary, and in this example, each has a tube or outer electrical contact 83 that stabs into one of the hanger inner electrical contacts 57. An insulated electrical conductor lead 85 extends from a power supply (not shown) through tube passage 30 to outer electrical contact 83. An insulator 87 in tube passage 30 surrounds conductor lead 85 and secures by threads to outer electrical contact 83. A coil spring 89 is compressed between the outer end of insulator 87 and a spring retaining nut 91. Nut 91 secures by threads 93 to the outer end of tube 29. Spring 89 urges insulator 87 and outer electrical contact 83 inward to maintain electrical continuity with inner electrical contact 57.

Figure 8:
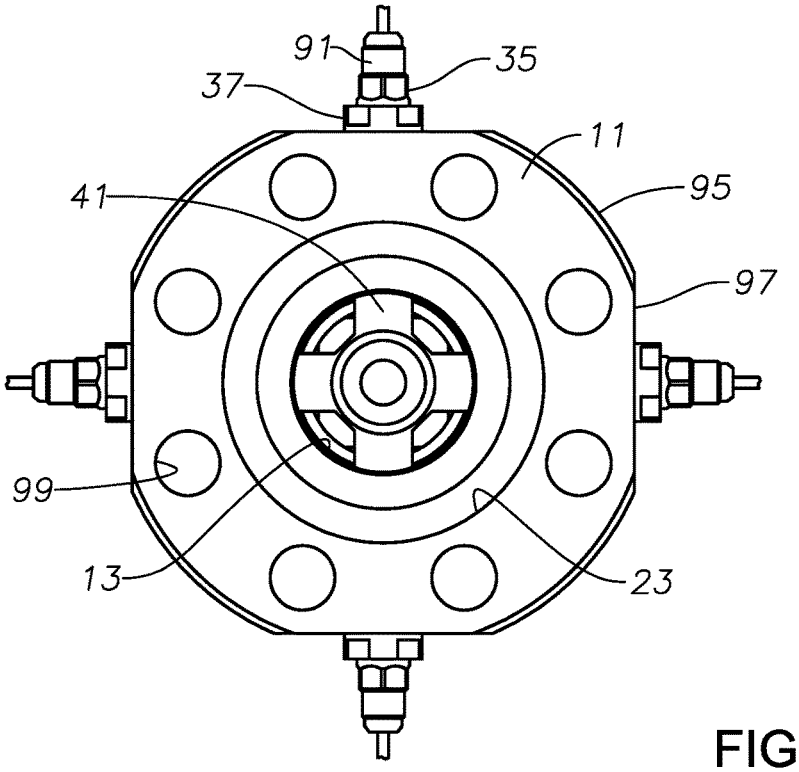
FIG. 8 is a top view of the flange with the hanger installed.

FIG. 8 shows a top plan view of flange 11 with hanger 41 installed. Flange 11 may have a cylindrical periphery with flats 97 machined for each tube 29. Axial bolt holes 99 are spaced around flange axial bore 13 for bolting flange 11 to upper and lower spools 19, 21 (FIG. 6). Alternately, flange 11 could be secured to upper and lower spools 19, 21 with a clamp extending around the periphery of flange 11.

During completion of the well, tubes 29 may be in the retracted position, as shown in FIG. 1, for passing equipment through production tree bore 25 and flange bore 13. The operator will run coiled tubing 77 through production tree bore 25 and flange bore 13. If an ESP is secured to the lower end of coiled tubing 77, power cable 79 (FIG. 5) will have previously been installed in coiled tubing 77. The motor of the ESP will be secured to power cable 79 and to the lower end of coiled tubing 77.

As the ESP nears the desired depth, the operator installs coiled tubing lower connector portion 73 on the upper end portion of coiled tubing 77. Technicians secure terminals to the upper ends of insulated conductors 61 and insert the upper end portions of insulated conductors 61 through coiled tubing upper connector portion 53, insulator 63 and into cap 55. The operator secures hanger 41 to coiled tubing connector portion 53 and inserts inner electrical contacts 57 through insulators 59 into electrical engagement with the terminals on the upper ends of insulated conductors 61. Technicians will rotate adjustment nuts 35 to position tubes 29 in the intermediate position of FIG. 2. Then, the operator will lower hanger 41 and land it on tubes 29. Then, technicians will rotate adjustment nuts 35 to the extended position, with tube sealing faces 39 sealing against insulators 59.

The operator pressure tests the engagement between tubes 29 and hanger 41 and removes plugs 40. Technicians then install tube electrical connectors 81 in at least three of the tubes 29 with outer electrical contact 83 engaging inner electrical contact 57. The technicians connect conductor leads 85 to a power source to supply power down power cable 79 (FIG. 5) to the ESP.

While only one embodiment has been given for purposes of disclosure, numerous changes exist in the details for accomplishing the desired results. These and other similar modifications will readily suggest themselves to those skilled in the art, and are intended to be encompassed within the scope of the appended claims.

The invention claimed is:

1. A wellhead assembly, comprising:

a tubular wellhead body having a wellhead axial bore with an axis;

a wellhead radial bore extending along a radial line from an outer periphery of the wellhead body to the wellhead axial bore;

a hanger having a landed position within the wellhead axial bore, the hanger having a hanger axial bore;

a hanger radial port extending radially from an exterior surface of the hanger to the hanger axial bore;

a tube sealingly carried in the wellhead radial bore, the tube being movable between a retracted position and an extended position, the tube having an inner end that is recessed in the wellhead radial bore while in the retracted position and protrudes into the wellhead axial bore into engagement with the hanger radial port while in the extended position; and a flow passage between the exterior surface of the hanger and a side wall of the wellhead axial bore, enabling a flow of fluid up and down the wellhead axial bore while the hanger is in the landed position.

2. The assembly according to claim 1, further comprising:

a landing shoulder on the hanger, the landing shoulder resting on an inner end portion of the tube while the tube is in the extended position and the hanger is in the landed position; and wherein a load imposed on the hanger is transferred to the tube while the hanger is in the landed position.

3. The assembly according to claim 1, wherein:

the tube is movable to an intermediate position between the retracted and extended positions prior to the hanger being lowered to the landed position; and the hanger further comprises:

an alignment slot extending downward from the hanger radial port, the alignment slot having opposed cam surfaces converging toward each other in an upward direction that slidingly engage the tube while the tube is in the intermediate position and the hanger is being lowered into the wellhead axial bore, causing the hanger to rotationally orient the hanger radial port with the inner end of the tube; and wherein subsequent movement of the tube from the intermediate position to the extended position causes the inner end of the tube to sealingly engage the hanger radial port.

4. The assembly according to claim 1, wherein:

the tube is movable to an intermediate position between the retracted and extended positions prior to the hanger being lowered to the landed position; and the hanger further comprises:

an alignment slot extending downward from the hanger radial port, the alignment slot having opposed cam surfaces converging toward each other in an upward direction that slidingly engage the tube while the tube is in the intermediate position and the hanger is being lowered into the wellhead axial bore, so as to rotate the hanger to orient the hanger radial port with the inner end of the tube; and a landing shoulder at an upper end of the alignment slot that lands on the tube while the tube is in the intermediate position and transfers a load on the hanger to the tube.

5. The assembly according to claim 1, wherein:

the tube is movable to an intermediate position between the retracted and extended positions prior to the hanger being lowered to the landed position; and the hanger further comprises:

a hanger body;

a guide member extending around and affixed to the hanger body;

an alignment slot in the guide member and extending downward from the hanger radial port, the alignment slot having opposed cam surfaces converging toward each other in an upward direction that slidingly engage the tube while the tube is in the intermediate position and the hanger is being lowered into the wellhead axial bore, causing the hanger to rotationally orient the hanger radial port with the inner end of the tube; and wherein a portion of the flow passage extends between the hanger body and the guide member.

6. The assembly according to claim 5, wherein the flow passage comprises:

an annular cavity extending around the hanger body, the guide member surrounding the annular cavity, the hanger radial port being located above the annular cavity;

a lower flow channel between the guide member and the hanger body and leading from a lower portion of the hanger body to the annular cavity, the lower flow channel being positioned in vertical alignment with the hanger radial port;

an upper flow channel between the guide member and the hanger body and leading upward from the annular cavity, the upper flow channel being rotationally offset from the radial port and the lower flow channel; and wherein upward flowing fluid flows through the lower flow channel, the annular cavity, and the upper flow channel.

7. The assembly according to claim 1, further comprising:

a threaded adjustment nut on an outer end portion of the tube and an outer portion of the wellhead body for moving the tube between the retracted and extended positions in response to rotation of the adjustment nut.

8. The assembly according to claim 1, wherein:

the hanger has a maximum outer diameter that is less than a minimum inner diameter of the wellhead axial bore.

9. The assembly according to claim 1, further comprising:

a string of coiled tubing containing an electrical cable;

a coiled tubing head at an upper end of the string of coiled tubing and mounted within the hanger axial bore, the coiled tubing head having a coiled tubing head electrical contact aligned with the radial port in the hanger; and a tube electrical contact within a tube bore of the tube, the tube electrical contact being in engagement with the coiled tubing head electrical contact while the tube is in the extended position.

10. A wellhead assembly, comprising:

a tubular wellhead body having a wellhead axial bore with an axis;

a wellhead radial bore extending along a radial line from an outer periphery of the wellhead body to the wellhead axial bore;

a hanger having a hanger axial bore;

a hanger radial port extending radially from an exterior surface of the hanger to the hanger axial bore;

a tube sealingly carried in the wellhead radial bore;

a tube moving mechanism mounted to the wellhead body that selectively moves the tube between a retracted position, an intermediate position and an extended position, the tube having an inner end that is recessed in the wellhead radial bore while in the retracted position, that protrudes a first distance into the wellhead axial bore while in the intermediate position, and which protrudes a second distance into engagement with the hanger radial port while in the extended position;

a landing shoulder on the hanger above the radial port that lands on an inner portion of the tube while the tube is in the intermediate position and the hanger is being lowered into wellhead axial bore, transferring a load on the hanger to the tube; wherein the tube moving mechanism selectively moves the tube from the intermediate position to the extended position after the hanger has landed on the inner portion of the tube; and a flow passage between the exterior surface of the hanger and a side wall of the wellhead axial bore, enabling a flow of fluid up and down the wellhead axial bore after the hanger has landed on the inner portion of the tube and the tube is in the extended position.

11. The assembly according to claim 10, further comprising:

an alignment slot extending downward from the hanger radial port, the alignment slot having opposed cam surfaces converging toward each other in an upward direction that slidingly engage the inner portion of the tube while the tube is in the intermediate position and the hanger is being lowered into the wellhead axial bore, causing the hanger to rotationally orient the hanger radial port with the inner end of the tube; and wherein the landing shoulder defines an upper end of the alignment slot.

12. A wellhead assembly, comprising:

a tubular wellhead body having a wellhead axial bore with an axis;

a wellhead radial bore extending along a radial line from an outer periphery of the wellhead body to the wellhead axial bore;

a hanger having a hanger axial bore;

a hanger radial port extending radially from an exterior surface of the hanger to the hanger axial bore;

a tube sealingly carried in the wellhead radial bore;

a tube moving mechanism mounted to the wellhead body that selectively moves the tube between a retracted position, an intermediate position and an extended position, the tube having an inner end that is recessed in the wellhead radial bore while in the retracted position, that protrudes a first distance into the wellhead axial bore while in the intermediate position, and which protrudes a second distance into engagement with the hanger radial port while in the extended position;

a landing shoulder on the hanger above the radial port that lands on an inner portion of the tube while the tube is in the intermediate position and the hanger is being lowered into wellhead axial bore, transferring a load on the hanger to the tube; wherein the tube moving mechanism selectively moves the tube from the intermediate position to the extended position after the hanger has landed on the inner portion of the tube;

wherein the hanger further comprises:

a hanger body;

a guide member extending around and affixed to the hanger body;

an alignment slot in the guide member and extending downward from the hanger radial port, the alignment slot having opposed cam surfaces converging toward each other in an upward direction that slidingly engage the inner portion of the tube while the tube is in the intermediate position and the hanger is being lowered into the wellhead axial bore, causing the hanger to rotationally orient the hanger radial port with the inner end of the tube; and a flow passage extending between the hanger body and the guide member, enabling a flow of fluid up and down the wellhead axial bore after the hanger is in the landed position.

13. The assembly according to claim 12, wherein the tube moving mechanism comprises a threaded adjustment nut.

14. The assembly according to claim 12, further comprising:

a string of coiled tubing containing an electrical cable;

a coiled tubing head at an upper end of the string of coiled tubing and mounted within the hanger axial bore, the coiled tubing head having a coiled tubing head electrical contact aligned with the radial port in the hanger; and a tube electrical contact within a tube bore of the tube, the tube electrical contact being in engagement with the coiled tubing head electrical contact while the tube is in the extended position.

15. A wellhead assembly, comprising:

a tubular wellhead body having a wellhead axial bore with an axis and a plurality of bolt holes spaced around the wellhead axial bore parallel with the axis for receiving bolts to bolt the wellhead body to components of a well production tree;

a plurality of wellhead radial bores extending along radial lines from an outer periphery of the wellhead body to the wellhead axial bore;

a hanger having a hanger axial bore;

a plurality of hanger radial ports extending radially through the hanger to the hanger axial bore;

a plurality of alignment slots on an outer surface of the hanger, each of the alignment slots having opposed cam surfaces converging toward each other in an upward direction to a downward facing landing shoulder, each of the landing shoulders being located above one of the radial ports;

a plurality of tubes, each sealingly carried in one of the radial bores;

a plurality of threaded adjustment nuts, each on an outer end portion of one of the tubes, the adjustment nuts selectively sliding the tubes between the retracted, intermediate and extended positions in response to rotation of the adjustment nuts; wherein while the tubes are in the retracted position, an inner end of each of the tubes is recessed from the wellhead axial bore;

while the tubes are in the intermediate position, the inner ends of the tubes protrude from the hanger radial bores into the wellhead axial bore a first distance, enabling the hanger to be lowered into the wellhead axial bore and the alignment slots to slide down inner end portions of the tubes and rotate the hanger to align the radial ports with the inner ends of the tube;

the landing shoulders land on the inner end portions of the tubes and transfer a load on the hanger to the tubes when the hanger reaches a landed position; and while the tubes are in the extended position, the inner end of each of the tubes sealingly engages one of the radial ports.

16. The assembly according to claim 15, further comprising:

at least one flow channel on the outer surface of the hanger that enables upward and downward flow between the hanger and a side wall of the wellhead axial bore while the hanger is in the landed position.

17. The assembly according to claim 15, wherein the hanger further comprises:

a hanger body;

a guide member having a receptacle that receives the hanger body, the guide member being secured to the hanger; and wherein the alignment slots are formed in the guide member.

18. The assembly according to claim 17, further comprising:

an annular cavity extending around the hanger body, the guide member surrounding the annular cavity, the hanger radial ports being located above the annular cavity;

a plurality of lower flow channels between the guide member and the hanger body and leading from a lower portion of the hanger body to the annular cavity, each of the lower flow channels being positioned in vertical alignment with one of the hanger radial ports;

a plurality of upper flow channels between the guide member and the hanger body and leading upward from the annular cavity, each of the upper flow channel extending between adjacent ones of the hanger radial ports; and wherein the lower flow channels, annular cavity and upper flow channels define continuously open flow paths between an inner side wall of the wellhead axial bore and the hanger.

19. The assembly according to claim 15, further comprising:

a string of coiled tubing containing an electrical cable;

a coiled tubing head at an upper end of the string of coiled tubing and mounted within the hanger axial bore, the coiled tubing head having a plurality of coiled tubing head electrical contacts, each aligned with one of the radial ports in the hanger; and a plurality of tube electrical contacts, each within one of the tubes, the tube electrical contacts being in engagement with the coiled tubing head electrical contacts while the tubes are in the extended position.

20. The assembly according to claim 15, wherein:

the hanger has a maximum outer diameter that is less than a minimum inner diameter of the wellhead axial bore.

* * * * *